US005306170A

United States Patent [19]

Luu

[11] Patent Number: 5,306,170

[45] Date of Patent: Apr. 26, 1994

[54] ELECTRICAL PIPE FITTING WITH INTEGRAL GROUNDING FIXTURE

[75] Inventor: Lu V. Luu, Hong Kong, Hong Kong

[73] Assignee: Pacomex Industries, Inc., Indianapolis, Ind.

[21] Appl. No.: 94,213

[22] Filed: Jul. 21, 1993

[51] Int. Cl.[5] ..... H01R 13/648

[52] U.S. Cl. ..... 439/100; 439/208; 285/127

[58] Field of Search ..... 439/100, 208; 174/78; 285/128, 175, 127

[56] References Cited

U.S. PATENT DOCUMENTS

| | | | |
|---|---|---|---|
| 1,660,498 | 2/1928 | Vibber | 439/208 |
| 2,955,851 | 10/1960 | Scott | 285/127 |
| 3,168,104 | 2/1965 | Mathis | 285/127 |
| 3,424,853 | 1/1969 | Johnson, III | 174/78 |
| 3,832,672 | 8/1974 | Loos | 439/208 |
| 4,090,029 | 5/1978 | Lundeberg | 174/51 |
| 4,106,832 | 8/1978 | Burns | 439/100 |
| 4,312,551 | 1/1982 | Mascolo et al. | 439/100 |
| 4,508,371 | 4/1985 | Maier | 285/127 |

FOREIGN PATENT DOCUMENTS

| | | | |
|---|---|---|---|
| 2139724 | 11/1984 | United Kingdom | 439/100 |

*Primary Examiner*—Gary F. Paumen

*Attorney, Agent, or Firm*—Ostrolenk, Faber, Gerb & Soffen

[57] ABSTRACT

An electrical pipe fitting with an integral fixture for securing a grounding wire. The pipe fitting includes a hollow metal tubular member for receiving electrical wire, the hollow tubular member being specifically designed to be coupled as an intermediate section of a grounded electrical pipe. A raised portion is formed integrally with and extends from the hollow tubular member. The raised portion has an aperture into which a grounding wire is received and secured by a screw to establish a ground path between the grounding wire and the electrical pipe. Additionally, a clamp is disposed adjacent the aperture for securing an insulated portion of the ground wire against hollow tubular member. The electrical pipe fitting can either be a straight section or, alternatively, can include an angled corner, so that the ends of the fitting are perpendicular to each other. A removable cover is preferably provided in the embodiment of the invention with the angled corner to facilitate access to the electrical wire. Locking means is provided to prevent unintentional dislodging of the removable cover.

6 Claims, 3 Drawing Sheets

ELECTRICAL PIPE FITTING WITH INTEGRAL GROUNDING FIXTURE

BACKGROUND OF THE INVENTION

1. Field of the Invention

The present invention relates to an electrical pipe fitting and, more particularly, to an electrical pipe fitting with an integral fixture for securing a grounding wire.

2. Description of the Related Art

Electrical pipe is often used for routing electrical wires in commercial and residential installations. In order to meet present day municipal code requirements, the electrical pipe must be grounded, and fixtures must be provided to electrically connect grounding wires to the grounded electrical pipe.

As shown in FIG. 1, the typical solution is to provide a clamp-on fixture consisting of a base 2 and a U-shaped pipe clamp bracket 4 which are secured around a pipe using screws 6 and 8. A portion 10 of the base 2 receives a grounding wire 11 which is held in grounded connection with the base by screw 12. A section 14 of the base may be used to secure a wire clamping bracket 16 over the grounding wire 11 using screws 18 and 20.

The clamp-on fixture illustrated in FIG. 1 suffers from several setbacks, including: (1) the ground connection is subject to failure, for example, if the clamp-on fixture should become loose; (2) the fixture adds expense and physical bulk to any given installation, requiring separate pieces of hardware which must be purchased, kept in stock and secured around the pipe or connector; (3) the clamp-on fixture adds to the time involved and increases the chance of error during the installation, involving several steps in order to secure and apply the grounding connection; and (4) the clamp may cause the electrical pipe, or conduit, to crimp.

Although U.S. Pat. No. 4,106,832 to Burns discloses an electrical ground fixture including a pipe section with an integral clamp, it is designed to electrically couple a grounding wire to a grounded water pipe system of a building. Significantly, the fixture of the Burns patent is not designed to provide a grounding connection for an electrical pipe system to meet today's building and electrical codes.

SUMMARY OF THE INVENTION

The present invention improves upon the prior art by providing a pipe fitting with an integral grounding fixture which is specifically designed to be used in an electrical conduit system to bring such a system into compliance with municipal code requirements.

The electrical pipe fitting of the present invention includes a hollow metal tubular member for receiving electrical wire, the hollow tubular member being specifically designed to be coupled as an intermediate section of a grounded electrical pipe. In this connection, one end of the hollow tubular member has ridges for securing a section of electrical pipe and a second end with external threads.

A raised portion is formed integrally with and extends from the hollow tubular member. The raised portion has an aperture into which a grounding wire is received and secured.

Preferably, a screw is used to secure the grounding wire within the aperture. The screw extends into the aperture of the raised portion of the fitting and presses an uninsulated portion of the ground wire against a wall of the aperture to establish a ground path between the grounding wire and the electrical pipe. Additionally, a clamp is preferably disposed adjacent the aperture for securing an insulated portion of the ground wire against the hollow tubular member.

The electrical pipe fitting can either be a straight section or, alternatively, can include an angled corner, such that the ends of the fitting are perpendicular to each other. A removable cover is preferably provided in the embodiment of the invention with the angled corner to facilitate access to the electrical wire. A frictional lock is provided to prevent unintentional dislodging of the removable cover.

Advantageously, the fixture of the present invention is simple, economical, easily installed and provides secure grounding at the point of connection.

Other features and advantages of the present invention will become apparent from the following description of the invention which refers to the accompanying drawings.

DETAILED DESCRIPTION OF PREFERRED EMBODIMENT

Figure 1:
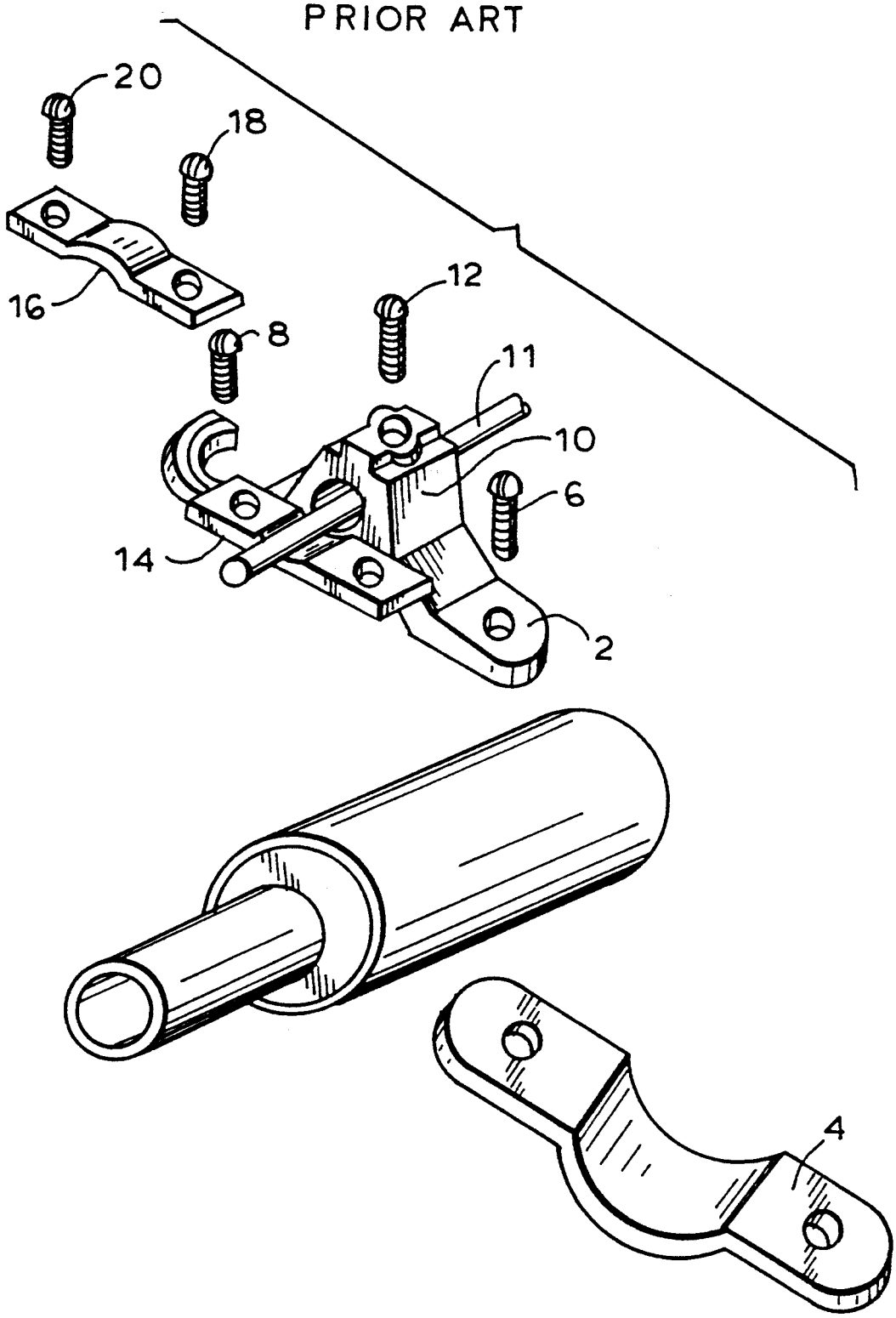
FIG. 1 PRIOR ART
FIG. 1 shows a typical clamp-on type grounding fixture currently in use.
Figure 2:
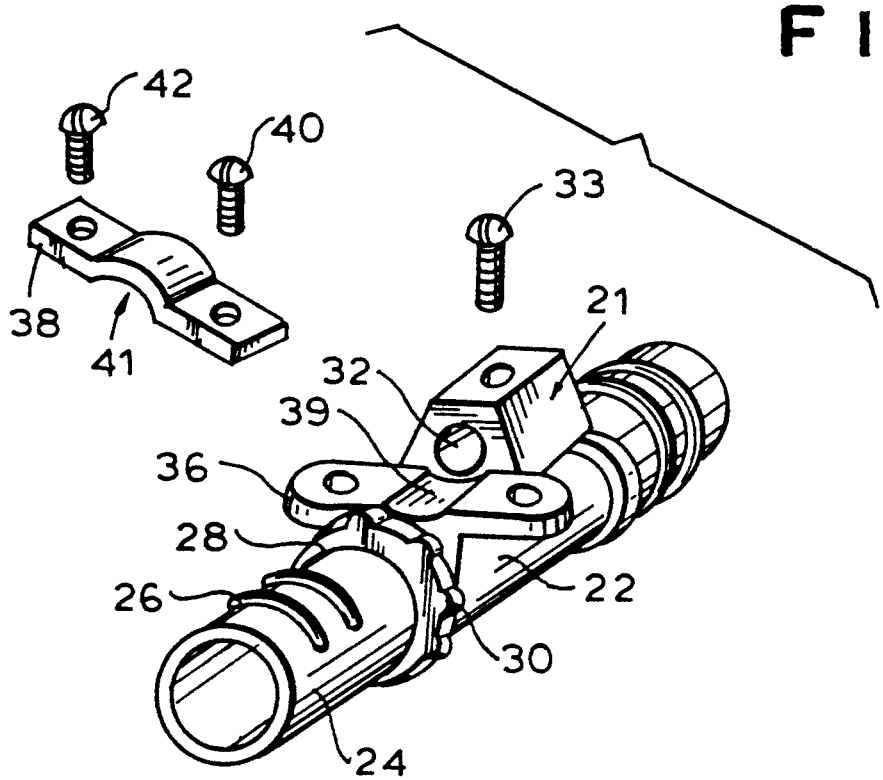
FIG. 2 shows a first embodiment of the invention associated with a straight electrical conduit connecting fixture.

Referring to FIG. 2, the present invention includes an electrical pipe fitting in the form of a hollow metal tubular member 22 for receiving electrical wire. A raised portion 21 extending from hollow tubular member 22 has an aperture 32 for receiving a grounding wire. A screw 33 extends into the aperture and presses an uninsulated portion of a grounding wire against a wall of aperture 32.

The hollow tubular member 22 is adapted to be coupled as an intermediate section of a grounded electrical pipe. The hollow tubular member 22 has one end 24 which fits snugly inside the end of a piece of electrical pipe or conduit. A number of small ridges 26 extend at least partially circumferentially around the end 24 to assist in securing the end 24 inside the conduit. When the end 24 is inserted fully, the conduit end comes to rest against a collar 28 on the hollow tubular member 22. The collar 28 has raised bumps 30 which afford a better grip on the hollow tubular member 22.

A platform 36 disposed adjacent raised portion 21 extends laterally with respect to tubular member 22 and includes a U-shaped recess 39 for receiving the grounding wire. A wire clamp bracket 38 with an opposing U-shaped recess 41 is secured onto platform 36 with two screws 40 and 42, the wire being held in place between recesses 39 and 41.

Figure 3:
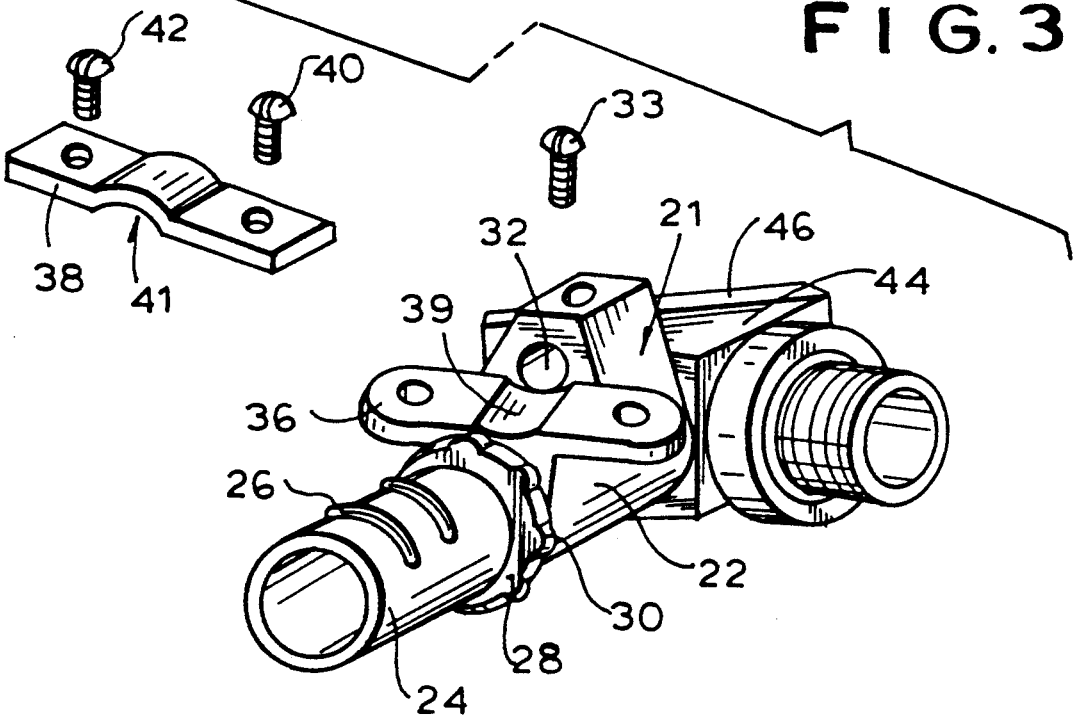
FIG. 3 shows an embodiment of the present invention in the form of an elbow connector.

Referring now to FIG. 3, wherein like reference numerals represent like elements with respect to the FIG. 2 embodiment, the hollow tubular member 22 is formed with an angled corner 44 to accommodate various installation configurations. A removable cover 46 is provided to facilitate installation and threading of electrical wires through the angle of the fitting. Removable cover 46 fits over an opening 45 in the angled corner 44.

Figure 4:
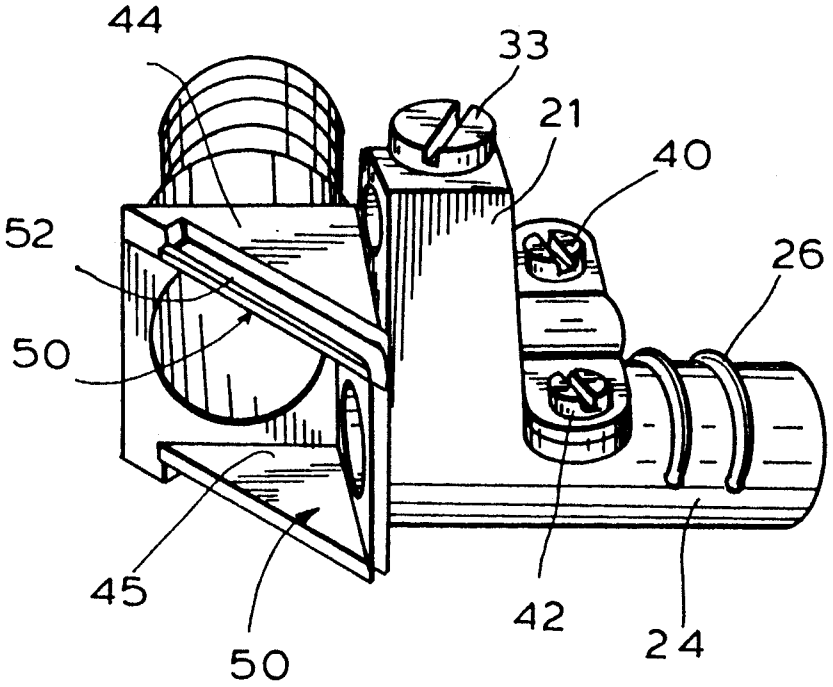
FIG. 4 is another view of the embodiment of the present invention shown in FIG. 3, showing the elbow in greater detail.
Figure 5:
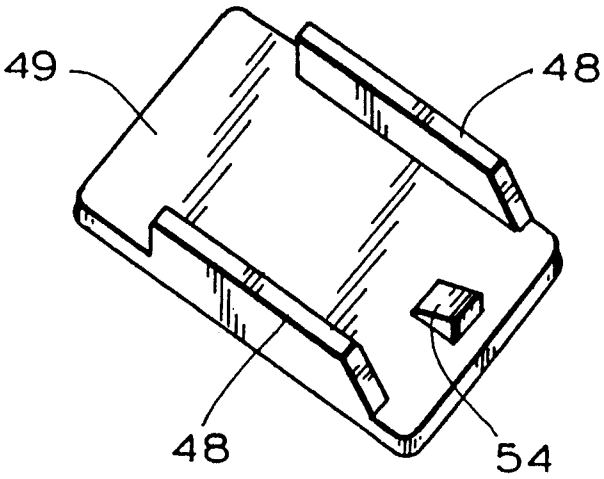
FIG. 5 shows the inner surface of the slidable cover used in the FIG. 3 embodiment of the present invention.

Referring now to FIGS. 4 and 5, a locking mechanism is provided to secure the removable cover 46 onto angled corner 44. As shown in FIG. 4, tracks 50 are provided on opposite sides of opening 45. The tracks are equipped with stops 52. As shown in FIG. 5, hooked projections 48 are provided on opposite edges extending from the inner surface 49 of removable cover 46. Removable cover 46 also includes a small ramp 54 at one end disposed midway between hooked projections 48. To install cover 46, hooked projections 48 are slidably engaged over tracks 50, and the cover 46 is slid forward until projections 48 come to rest against stops 52, at which point the removable cover fully occludes the opening. Inadvertent opening of removable cover 46 to expose opening 45 is impeded by ramp 54 which frictionally engages an edge 56 of the opening.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. An electrical pipe fitting, comprising:

a hollow metal tubular member for receiving electrical wire, said hollow tubular member adapted to be coupled as an intermediate section of a grounded electrical pipe, said hollow tubular member having a first end and a second end, the first end having ridges adapted to secure a section of said electrical pipe received over the first end, the second end being provided with external threads; and a raised portion formed integrally with and extending from said hollow tubular member, said raised portion having an aperture therethrough for receiving and securing a grounding wire, whereby a ground path is established between said grounding wire and said electrical pipe.

2. An electrical pipe fitting as recited in claim 1, wherein said means for securing said grounding wire comprises a screw which extends into said aperture of said raised portion and presses an uninsulated portion of said grounding wire against said wall of said aperture.

3. An electrical pipe fitting as recited in claim 2, wherein said means for securing said grounding wire further comprises a clamp disposed adjacent said aperture for securing an insulated portion of said grounding wire against said hollow tubular member.

4. An electrical pipe fitting as recited in claim 1, wherein said hollow tubular member includes an angled corner, such that said first and second ends are perpendicular to each other.

5. An electrical pipe fitting as recited in claim 4, further comprising a removable cover on said angled corner.

6. An electrical pipe fitting as recited in claim 5, wherein locking means is provided to prevent unintentional displacement of said removable cover.

* * * * *